US008523089B2

(12) United States Patent
Bamber et al.

(10) Patent No.: US 8,523,089 B2
(45) Date of Patent: Sep. 3, 2013

(54) PRESSURE SWIRL ATOMIZER WITH CLOSURE ASSIST

(75) Inventors: Daniel William Bamber, St. Clair Shores, MI (US); Steven Lee Ambrose, Farmington Hills, MI (US); Eric Otis Barrows, Richmond, MI (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 108 days.

(21) Appl. No.: 13/087,705

(22) Filed: Apr. 15, 2011

(65) Prior Publication Data

US 2011/0253807 A1 Oct. 20, 2011

Related U.S. Application Data

(60) Provisional application No. 61/324,793, filed on Apr. 16, 2010.

(51) Int. Cl.
*F02M 51/00* (2006.01)

(52) U.S. Cl.
USPC ..... 239/585.1; 239/124; 239/125; 239/132.5; 239/490; 239/492; 239/533.12; 239/585.5

(58) Field of Classification Search
USPC ..... 239/124, 127, 463, 468, 490–496, 239/533.12, 585.1, 585.4, 585.5, 125, 132, 239/132.5
See application file for complete search history.

(56) References Cited

U.S. PATENT DOCUMENTS

| | | | | |
|---|---|---|---|---|
| 4,292,947 | A * | 10/1981 | Tanasawa et al. | 239/124 |
| 5,207,384 | A * | 5/1993 | Horsting | 239/463 |
| 6,257,496 | B1 * | 7/2001 | Wyant | 239/492 |
| 6,439,482 | B2 * | 8/2002 | Hosoyama et al. | 239/463 |
| 6,513,732 | B1 * | 2/2003 | Sumida et al. | 239/585.4 |
| 7,328,684 | B2 * | 2/2008 | Saito et al. | 239/533.12 |
| 2008/0087739 | A1 * | 4/2008 | Tarabulski et al. | 239/533.12 |

* cited by examiner

*Primary Examiner* — Steven J Ganey
(74) *Attorney, Agent, or Firm* — Paul V. Keller

(57) ABSTRACT

A pressure swirl atomizer includes a nozzle having an exit orifice and a plurality of tangential swirl channels and a pintle that is movable within a pintle bearing between a closed position that closes the exit orifice and an open position that opens the exit orifice. The atomizer also has a pole piece having a channel, and the pole piece and the pintle are separated by an air gap when the pintle is in the closed position. A space between the pintle and the pintle bearing, the air gap, and the channel together form at least a part of a return path. Fluid from the tangential swirl channels drains through the return path when the pintle is in the closed position. To open the atomizer, a solenoid generates a magnetic force when energized, attracting the pintle toward the pole piece into the open position. A check valve disposed in the return path generates a fluid back pressure when the solenoid is de-energized to push the pintle toward the closed position. The fluid back pressure helps prevent the pintle from getting stuck in the open position.

8 Claims, 1 Drawing Sheet

PRESSURE SWIRL ATOMIZER WITH CLOSURE ASSIST

CROSS-REFERENCE TO RELATED APPLICATIONS

This application claims the benefit of U.S. Provisional application Ser. No. 61/324,793 filed Apr. 16, 2010 entitled FUEL INJECTOR CLOSURE ASSIST, the entire disclosure of which is hereby incorporated by reference herein.

TECHNICAL FIELD

The present invention relates to pressure swirl atomizers, and more particularly to a pressure swirl atomizer system that has a mechanism to assist in closing an exit flow path.

BACKGROUND OF THE INVENTION

Pressure swirl atomizers are used in various applications, including fuel injection systems and exhaust aftertreatment systems. Atomizers disperse fluid into a fine spray by directing fluid from tangential swirl channels into a swirl chamber and then opening a central exit orifice to allow the fluid to exit in a spray pattern. More particularly, the tangential swirl channels causes fluid entering the swirl chamber to swirl in a circular motion and increase its angular velocity as it moves toward the exit orifice. The centrifugal force generated by the swirling motion generates a low pressure zone along the central axis of the swirl chamber.

When the exit orifice is opened, exhaust gas enters the atomizer through the exit orifice and forms an air core through the exit orifice. The fluid forms a "wall" around the air core. Aerodynamic forces break the fluid wall into droplets after it exits the injector. The thickness of this fluid wall and the dimensions of the air core depend on the fluid supply pressure and on the ratio of the diameter of the swirl chamber and the diameter of the exit orifice, and these dimensions in turn control the characteristics of the spray pattern as fluid leaves the exit orifice.

A solenoid-controlled pintle opens and closes the exit orifice to allow or block fluid flow out of the atomizer. In applications where a variable flow rate is desired, the exit orifice may be opened and closed via pulse width modulation (PWM) of the pintle between the open and closed positions. When the solenoid is energized, it generates a magnetic force that pulls the pintle away from the exit orifice and toward a pole piece until the pintle seats against the pole piece. When the solenoid is de-energized, the pintle should return to the closed position and block the exit orifice. However, the pintle may stick in the open position, creating an unpredictable response delay before the exit orifice is closed again. This delay makes it difficult to obtain consistent fuel flow, especially at high duty cycles.

There is a desire for a pressure swirl atomizer having a more predictable, consistent pintle response.

SUMMARY OF THE INVENTION

A pressure swirl atomizer according to one embodiment of the invention includes a nozzle having an exit orifice and a plurality of tangential swirl channels and a pintle that is movable within a pintle bearing between a closed position that closes the exit orifice and an open position that opens the exit orifice. The atomizer also has a pole piece having a channel, and the pole piece and the pintle are separated by an air gap when the pintle is in the closed position. A space between the pintle and the pintle bearing, the air gap, and the channel together form at least a part of a return path. Fluid from the tangential swirl channels drains through the return path when the pintle is in the closed position. To open the atomizer, a solenoid generates a magnetic force when energized, attracting the pintle toward the pole piece into the open position. A check valve disposed in the return path generates a fluid back pressure when the solenoid is de-energized to push the pintle toward the closed position. The back pressure helps prevent the pintle from getting stuck in the open position.

DETAILED DESCRIPTION OF THE INVENTION

Figure 2:
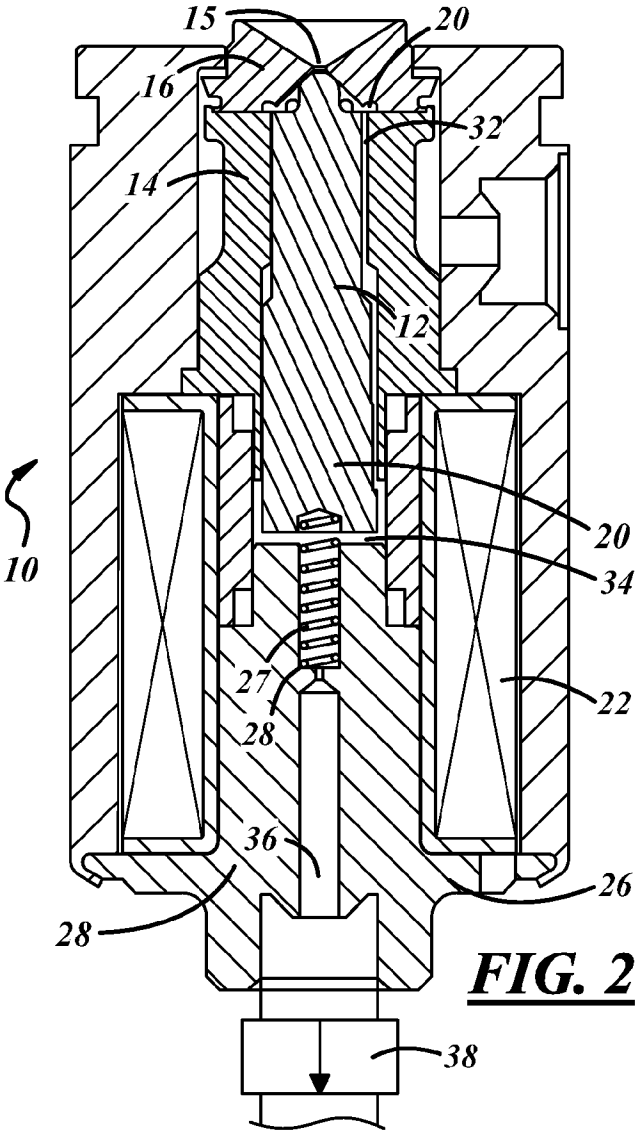
FIG. 2 is a cross-sectional view of the pressure swirl atomizer of FIG. 1 in the open position.
Figure 1:
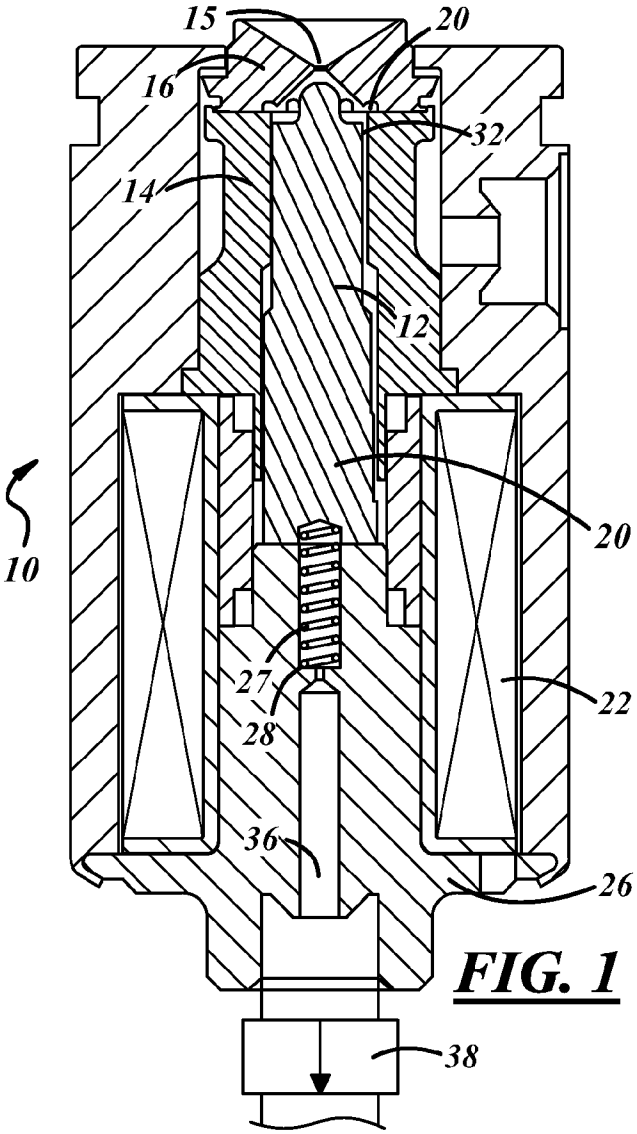
FIG. 1 is a cross-sectional view of a pressure swirl atomizer according to one embodiment of the invention shown in the closed position.

FIG. 1 illustrates a pressure swirl atomizer 10 according to one embodiment of the invention. The atomizer 10 has a pintle 12 disposed in a pintle bearing 14. In one embodiment, the pintle bearing 14 acts as a flux collector. The pintle 12 is movable to open and close an exit orifice 15 disposed at the center of a nozzle 16. As shown in FIG. 2, the nozzle 16 has a swirl chamber 18 to accelerate fluid in a swirl pattern before it sprays out of the exit orifice 15.

Figure 3:
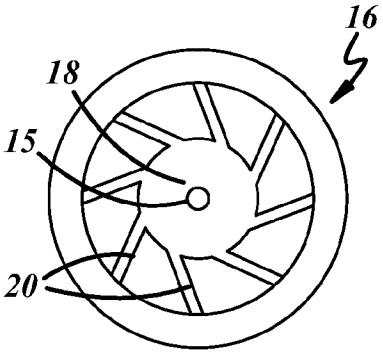
FIG. 3 is a plan view of the underside of one embodiment of a nozzle used in the pressure swirl atomizer of FIG. 1.

As shown in FIG. 3, a plurality of tangential swirl channels 19 are arranged tangentially to the perimeter of the swirl chamber 18 and direct fluid to the swirl chamber 18. A perimeter of the central swirl chamber 18, as defined by the contact points between the swirl channels 19 and the swirl chamber 18, forms a circle having a first diameter. The exit orifice 15 has a second diameter. The ratio between the first and second diameters controls the spray pattern of the atomizer 10 by controlling the size of an air core formed by the swirling fluid, the wall thickness of the swirling fluid itself, and the angular momentum of the fluid. As the fluid moves closer to the center of the swirl chamber 18, and therefore closer to the exit orifice 15, the angular velocity of the fluid increases.

A solenoid 22 controls operation of the atomizer 10 by moving the pintle 12 between an open position (FIG. 1) and a closed position (FIG. 2). In one embodiment, when the solenoid 22 is energized, it generates a magnetic force that pulls the pintle 12 toward a core 26 and away from the exit orifice 15 as shown in FIG. 1, allowing fluid to spray through the exit orifice 15 out of the atomizer 10. In one embodiment, the core 26 acts as a pole piece.

When the solenoid 22 is de-energized, the pintle 12 moves away from the core 26 and closes the exit orifice 15 as shown in FIG. 2. In one embodiment, a resilient member, such as a spring 27, applies a biasing force to bias the pintle 12 toward the closed position. The spring 27 may be disposed in a recess 28 in the core 26.

The solenoid 22 may operate via pulse width modulation (PWM) control to move the pintle 12 over a selected duty cycle to vary the flow rate of the atomizer 10. The solenoid 22 may be designed to provide a quick response at low duty cycles so that the pintle 12 can be moved quickly between the open and closed positions.

A housing 30 may house at least a portion of the nozzle 16, pintle 12, pintle bearing 14, solenoid 22, and core 26 into a single unit.

The operation of the components in the atomizer 10 will now be explained in greater detail with respect to FIGS. 1 and 2. When the solenoid 22 is de-energized, the pintle 12 is in the closed position as shown in FIG. 1 to block fluid from exiting the exit orifice 15. Fluid may continue to flow from the swirl channels 20 to the swirl chamber 18, but since the fluid cannot exit the atomizer 10, it drains through one or more return paths. In one embodiment, a portion of the return path is disposed in a space 32 between the pintle 12 and the pintle bearing 14.

When the pintle 12 is in the closed position, a magnetic air gap 34 forms between the pintle 12 and the core 26. This air gap 34 also forms part of the return path. In one embodiment, fluid flows through the air gap 34 into the core 26 through the recess 28 and a return channel 36. The recess 28 and return channel 36 also form part of the return path. The return path 32, 34, 36 may direct fluid to the solenoid 22 to cool it.

When the solenoid 22 is energized, the generated magnetic force pulls the pintle 12 toward the core 26 and away from the exit orifice 15. This attractive magnetic force causes the pintle 12 to contact the core 26 and close the magnetic air gap 34 between them, blocking fluid flow through the recess 28 and the channel 36 and forcing fluid to exit through the exit orifice 15 in a spray pattern. In one embodiment, the pintle 12 has a large magnetically attractive surface area to ensure that the pintle 12 responds quickly to the magnetic force.

When the solenoid 22 is de-energized again, the biasing force from the spring 27 urges the pintle 12 to the closed position. However, the large magnetically attractive surface area on the pintle 12 may cause the pintle 12 to stick in the open position or move too slowly toward the closed position if there is not enough hydraulic and/or spring force applied to the pintle 12 to force it away from the core 26.

To provide additional hydraulic pressure onto the pintle 12, a check valve 38 may be disposed in the return path to provide additional hydraulic force onto the pintle 12 to move it toward the closed position. The check valve 38 may be disposed anywhere along the return path, in any of the paths formed by the space 32 between the pintle 12 and pintle bearing 14, the air gap 34, and/or the channel 36, and either within the atomizer 10 or, as shown in FIGS. 1 and 2, mounted outside the atomizer 10.

In one embodiment, the check valve 38 is a low-leak check valve that is normally closed. When the pintle 12 is in the closed position, the pressure of fluid draining from the swirl chamber 18 is higher than a threshold pressure of the check valve 38, pushing the check valve 38 open. This allows the fluid to flow past the check valve 34 along the return path 32. This fluid circulation may cool portions of the atomizer, such as the solenoid 22.

When the pintle 12 is in the open position, the check valve 34 closes because the fluid pressure in the return path 28 drops below the threshold pressure of the check valve 34 due to the blockage of the return path 28 via closure of the air gap 30 by the pintle 12. The pintle 12 starts to move toward the closed position when the solenoid 22 is de-energized, allowing some fluid to flow through the air gap 30 and into the recess 28 and channel 32. However, since the check valve 34 is still closed, fluid quickly accumulates in the return path 28 between the check valve 34 and the pintle 12, increasing the back pressure against the pintle 12. This back pressure, combined with the biasing force of the spring 27, pushes the pintle 12 toward the closed position. The additional force provided by the fluid back pressure ensures that the pintle 12 quickly and reliably moves to the closed position when the solenoid 22 is de-energized.

Thus, by incorporating a check valve 34 in the return path 32, the fluid back pressure in the return path 32 pushes against the pintle 12 and prevents the pintle 12 from sticking in the open position when the atomizer 10 is commanded to close (e.g., via de-energization of the solenoid 22).

Although the embodiment described above has a flux collector as the pintle bearing 14 and a pole piece as the core 26, those of ordinary skill in the art will understand that these elements can be switched (i.e., the pintle bearing 14 can be the flux collector and the core 28 can be the pole piece). Other modifications may also be made without departing from the scope of the invention.

While the best modes for carrying out the invention have been described in detail, those familiar with the art to which this invention relates will recognize various alternative designs and embodiments for practicing the invention within the scope of the appended claims.

What is claimed is:

1. A pressure swirl atomizer, comprising:

a nozzle having an exit orifice and a plurality of tangential swirl channels;

a pintle that is movable between a closed position that closes the exit orifice and an open position that opens the exit orifice;

a pintle bearing;

a core having a channel, wherein the core and the pintle are separated by a gap when the pintle is in the closed position, the gap closing when the pintle moves to the open position;

a return path formed at least in part by a space between the pintle and the pintle bearing, the gap, and the channel, wherein fluid from the tangential swirl channels drains through the return path when the pintle is in the closed position, but not when the pintle is in the open position due to the gap being closed;

a solenoid that generates a magnetic force when energized to attract the pintle toward the core into the open position; and a check valve disposed in the return path, wherein the check valve closes when the gap closes and the resistance of the check valve to opening generates a fluid back pressure just as the pintle begins to close, the back pressure helping to push the pintle toward the closed position.

2. The pressure swirl atomizer of claim 1, wherein the check valve generates the fluid back pressure when the solenoid is de-energized.

3. The pressure swirl atomizer of claim 1, further comprising a resilient member that biases the pintle toward the closed position.

4. The pressure swirl atomizer of claim 3, further comprising a recess in the core, wherein the resilient member is disposed in the recess.

5. The pressure swirl atomizer of claim 1, further comprising a housing, wherein at least a portion of the nozzle, the pintle, the pintle bearing, and the solenoid are disposed inside the housing.

6. The pressure swirl atomizer of claim 5, wherein the check valve is disposed inside the housing.

7. The pressure swirl atomizer of claim 5, wherein the check valve is disposed outside the housing.

8. The pressure swirl atomizer of claim 7, wherein the check valve is mounted to the housing.

* * * * *